US005664434A

United States Patent [19]

Sugie et al.

[11] Patent Number: 5,664,434

[45] Date of Patent: Sep. 9, 1997

[54] AUGER AND AUGER TYPE ICE MAKING MACHINE USING THE AUGER

[75] Inventors: Hiroyuki Sugie, Tokai; Noboru Watanabe, Nagoya, both of Japan

[73] Assignee: Hoshizaki Denki Kabushiki Kaisha, Toyoake, Japan

[21] Appl. No.: 523,117

[22] Filed: Sep. 1, 1995

[30] Foreign Application Priority Data

Sep. 8, 1994 [JP] Japan ..... 6-214912
Dec. 19, 1994 [JP] Japan ..... 6-315268

[51] Int. Cl.[6] ..... F25C 1/14

[52] U.S. Cl. ..... 62/354

[58] Field of Search ..... 62/354; 165/94

[56] References Cited

U.S. PATENT DOCUMENTS 3,245,225 4/1966 Wallace ..... 62/354
3,521,457 7/1970 Hemstreet ..... 62/354
3,643,454 2/1972 Turner ..... 62/354
3,740,963 6/1973 Lyman et al. ..... 62/354
3,869,875 3/1975 Verlinden et al. ..... 62/354
4,923,223 5/1990 Paul et al. ..... 62/354

*Primary Examiner*—William E. Tapolcai
*Attorney, Agent, or Firm*—Wenderoth, Lind & Ponack

[57] ABSTRACT

An auger is accommodated in a vertically disposed cylindrical refrigerated casing for scratching an ice layer made around the inner periphery of the refrigerated casing and feeding the scratched ice upward. The auger includes a columnar main body and a spiral blade disposed around the outer periphery of the main body. The cross section of the spiral blade in the axial direction of the main body is formed of an upper end surface extending outward in a radial direction from the main body, a lower end surface spaced axially from the upper end surface and extending outward in the radial direction from the main body, and a tapered surface linearly connecting both the extreme ends of the upper end surface and the lower end surface. The tapered surface extends upwardly and radially inwardly from a radially outermost portion of the extreme end of the lower end surface.

5 Claims, 5 Drawing Sheets

AUGER AND AUGER TYPE ICE MAKING MACHINE USING THE AUGER

BACKGROUND OF THE INVENTION

1. Field of the Invention

The present invention relates to an auger type ice making machine using a motor-driven auger, and more specifically, to an auger for an auger type ice making machine capable of reducing drive torque and the like.

2. Description of the Related Art

As is known well, an auger type ice making machine supplies ice-making water into a refrigerated casing having a cooling pipe wound around the outer periphery thereof, scratches or scrapes an ice layer iced around the inner periphery of the refrigerated casing by an auger having a spiral blade, and forces the scratched ice into an ice compressing passage of a press head positioned at the upper end portion of the refrigerated casing so as to continuously make, for example, ice cubes.

FIG. 7 is an enlarged view partly showing a spiral blade of a conventional auger type ice making machine, wherein numeral 1 denotes a refrigerated casing, numeral 2 denotes an auger rotatably disposed in the refrigerated casing 1, numeral 3 denotes a spiral blade formed around the outer periphery of the auger 2, and numeral 4 denotes a cooling pipe wound around the outer periphery of the refrigerated casing 1. As is apparent from a longitudinal cross sectional view shown in FIG. 7, the outermost portion in a radial direction of the conventional spiral blade 3 is composed of a lower side axial or vertical portion 3*a* and an upper side tapered portion 3*b* which inclines upwardly and inwardly in the radial direction from the vertical portion 3*a*, so that when the spiral blade 3 is advanced in a screw fashion by rotating the auger 2, the spiral blade 3 wears away or scratches or scrapes an ice layer 5 at the boundary between the vertical portion 3*a* and the tapered portion 3*b*.

Further, as shown in FIG. 8, there is also known a spiral blade 7 of an auger 6 which has the outermost portion in the radial direction thereof composed only of a tapered portion 7*c* extending upward while inclining outwardly, so that the ice layer 5 is worn away or scratched or scraped by the upper edge at the extreme end of the tapered portion 7*c*.

Consideration will be made to a given portion of the refrigerated casing 1 in relation to the auger including the spiral blade 3 shown in FIG. 7. When a portion of the spiral blade 3 scratches an ice layer at the given portion and then the portion of the spiral blade 3 returns to the given portion again, ice grows on the ice layer which could not be scratched by the spiral blade 3. Since the grown ice strongly presses the vertical portion 3*a* in the radial direction and applies an excessive load to the auger 2, a problem arises in that the refrigerated casing 1 is deformed and the burden of the bearing (not shown) of the auger 2 is increased unless a scratching force is increased by increasing a drive force of a motor for driving the auger 2. Further, a problem also arises in that ice is held between the inner periphery of the refrigerated casing 1 and the vertical portion 3*a* in a compressed state and noise may be made when the ice is scratched.

On the other hand, the auger provided with the spiral blade 7 shown in FIG. 8 can prevent the application of an excessive load to the auger 6 because blade 7 does not include a vertical portion. However, since the surface of the taper portion 7*c* faces downward and does not act to feed ice upward under pressure, when a clearance between the blade tip and the refrigerated casing is increased because the outside dimension of the blade tip is made relatively small by a production error or reduced by wear or the like, there is caused a drawback that ice making capability is extremely lowered.

SUMMARY OF THE INVENTION

An object of the present invention is to provide an auger capable of improving an ice making capacity without increasing a load on a motor for driving the auger and an auger type ice making machine using such auger.

An auger according to a first aspect of this invention includes a columnar main body and a spiral blade disposed around the outer periphery of the main body. The spiral blade includes an upper end surface extending radially outward from the main body, a lower end surface spaced apart from the upper end surface in the axial direction of the main body and extending radially outward from the main body outward, and a tapered surface linearly connecting both the extreme ends of the upper end surface and the lower end surface. The tapered surface has at an innermost location in the radial direction at the extreme end of the upper end surface and an outermost location in the radial direction at the extreme end of the lower end surface.

An auger according to a second aspect of this invention includes a columnar main body and a spiral blade disposed around the outer periphery of the main body. The spiral blade includes an upper end surface extending radially outward from the main body, a lower end surface spaced apart from the upper end surface in the axial direction of the main body and extending radially outward from the main body and a tapered portion including a plurality of tapered surfaces connecting both the extreme ends of the upper end surface and the lower end surface. The tapered portion includes an innermost location in the radial direction at the extreme end of the upper end surface, and an outermost location in the radial direction at the extreme end of the lower end surface. The tapered surfaces are inclined at different angles to each other.

An auger type ice making machine according to a third aspect of this invention uses the auger of the first or second inventions.

DESCRIPTION OF PREFERRED EMBODIMENTS

Preferred embodiments of the present invention will be described in detail with reference to accompanying drawings.

Embodiment 1

Figure 1:
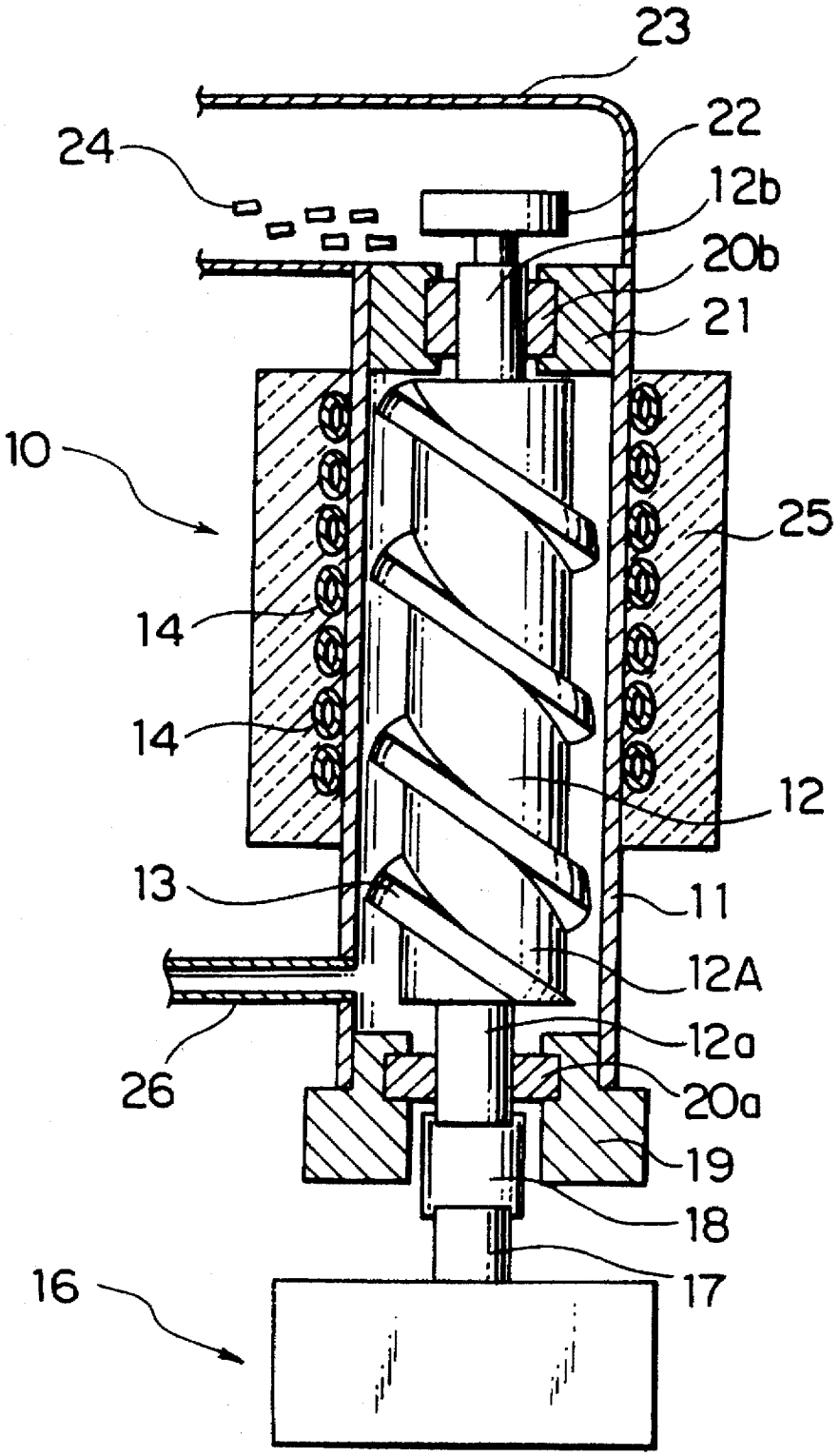
FIG. 1 is a longitudinal cross sectional view showing the overall arrangement of an auger type ice making machine according to the present invention.

FIG. 1 is a longitudinal cross sectional view showing the overall arrangement of an auger type ice making machine provided with an auger according to an embodiment 1, wherein an auger type ice making machine 10 includes a cylindrical refrigerated casing 11 having a cooling pipe 14 wound around the outer periphery thereof and an auger 12 having a spiral blade 13 disposed on a columnar main body 12A and mounted in the refrigerated casing 11 by being rotatably supported by bearings 20*a* and 20*b*. A shaft portion 12*a* of the auger 12 supported by the lower bearing 20*a* is coupled with the output shaft 17 of a drive motor 16 though a well-known spline coupling 18, while a bar-shaped cutter 22 is disposed at the upper end of an upper side shaft portion 12*b* supported by the upper bearing 20*b*.

The lower bearing 20*a* is accommodated in an approximately cylindrical support member 19 capable of being mounted on the lower end of the refrigerated casing 11, while the upper bearing 20*b* is accommodated in a press head 21 mounted at the upper end of the refrigerated casing 11. Although not shown, the press head 21 includes a plurality of concave ice compressing passages each extending in an axial direction and flake-shaped ice passing therethrough is compressed and formed into ice columns. The ice columns discharged into a discharge cylinder 23 from the press head 21 are cut off by the cutter 22 to form ice cubes 24.

Further, the cooling pipe 14 is covered with a suitable heat insulting material 25. A water supply pipe 26 is connected to the lower end of the refrigerated casing 11 so that a fluid can flow therethrough and ice making water from a not shown ice making water tank is supplied into the refrigerated casing 11 through the water supply pipe 26.

Figure 2:
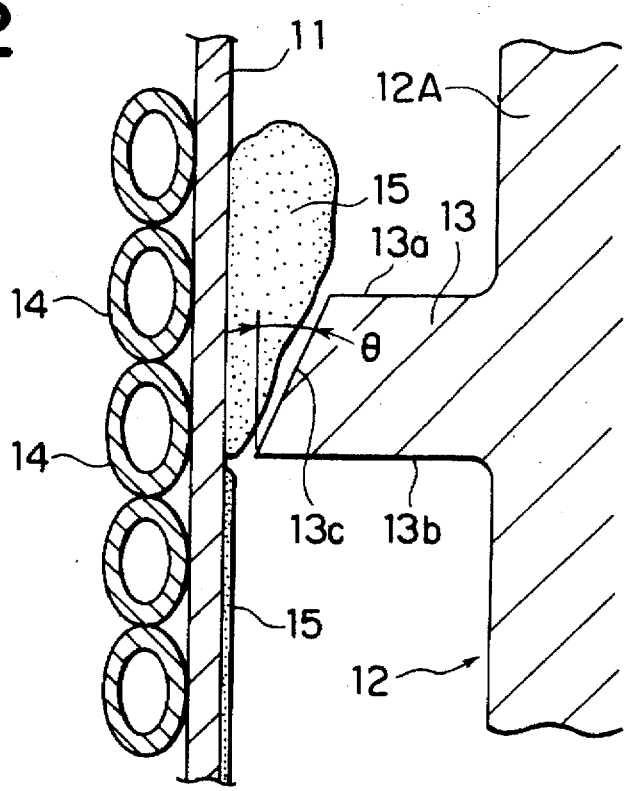
FIG. 2 is an enlarged cross sectional view showing a spiral blade of an auger in the auger type ice making machine of FIG. 1.

FIG. 2 shows a state that an ice layer 15 is formed around the inner periphery of the refrigerated casing 11 by operating the auger type ice making machine 10 of FIG. 1. When the spiral blade 13 projecting from the main body 12A of the auger 12 is observed through the longitudinal cross section thereof, the spiral blade 13 is composed of an upper end surface 13*a*, a lower end surface 13*b* and a tapered surface 13*c* connecting the upper end surface 13*a* to the lower end surface 13*b*. In the longitudinal cross section shown in FIG. 2, the tapered surface 13*c* extends substantially linearly inwardly in a radial direction from the lower end edge to the upper end edge thereof and the lower end edge is positioned at the radially outermost location of the tapered surface 13*c*. Although an angle of inclination $\theta$ of the tapered surface 13*c* is 10° in the illustrated embodiment, it may be within a range of $0° < \theta < 33.6°$ and is preferably from 5° to 15°.

Note, although the upper end surface 13*a* and the lower end surface 13*b* are illustrated to horizontally extend from the main body of the auger 12 in FIG. 2, it is essential only that the tapered surface 13*c* extends as described above, and the present invention is not limited by sizes in the radial direction of the upper and lower end surfaces, directions in which they extend and a size of the tapered surface in the axial direction thereof.

Next, operation of the auger type ice making machine 10 of this embodiment arranged as mentioned above will be described. When the auger type ice making machine 10 is operated, ice making water is supplied from the water supply pipe 26 to a predetermined water level in the refrigerated casing 11, a not shown refrigerating unit is operated to cause a coolant to flow through the cooling pipe 14, the ice making water is cooled through the refrigerated casing 11, and the drive motor 16 is driven.

When the drive motor 16 is driven, the auger 12 is rotated through the output shaft 17 and the spline coupling 18, the ice layer 15 (refer to FIG. 2) made around the inner periphery of the refrigerated casing 11 is fed upward while being scratched or scraped by the spiral blade 13 and put into the not shown ice compressing passages of the press head 21 and compressed therein so as to form ice columns. The ice columns discharged into the discharge cylinder 23 from the ice compressing passages are cut off by the cutter 22 rotating together with the auger 12 to form ice cubes 24 each having a suitable length.

Figure 3A:
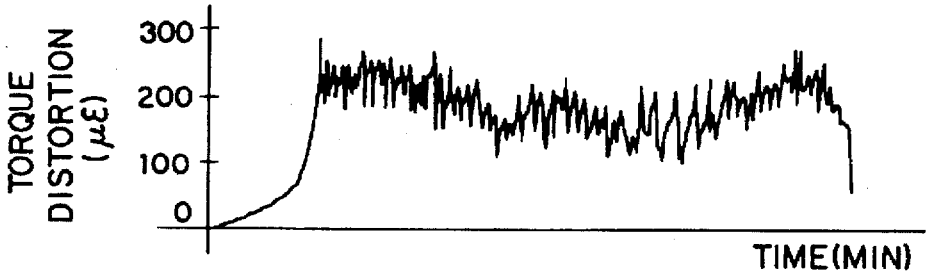
FIG. 3A and FIG. 3B are graphs showing measured data of torque distortion when an auger type ice making machine provided with a conventional auger and an auger type ice making machine provided with the auger of FIG. 2 are operated, respectively.
Figure 3B:
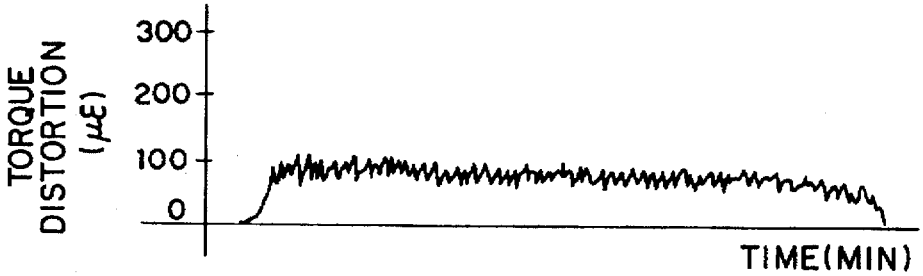
Figure 4B:
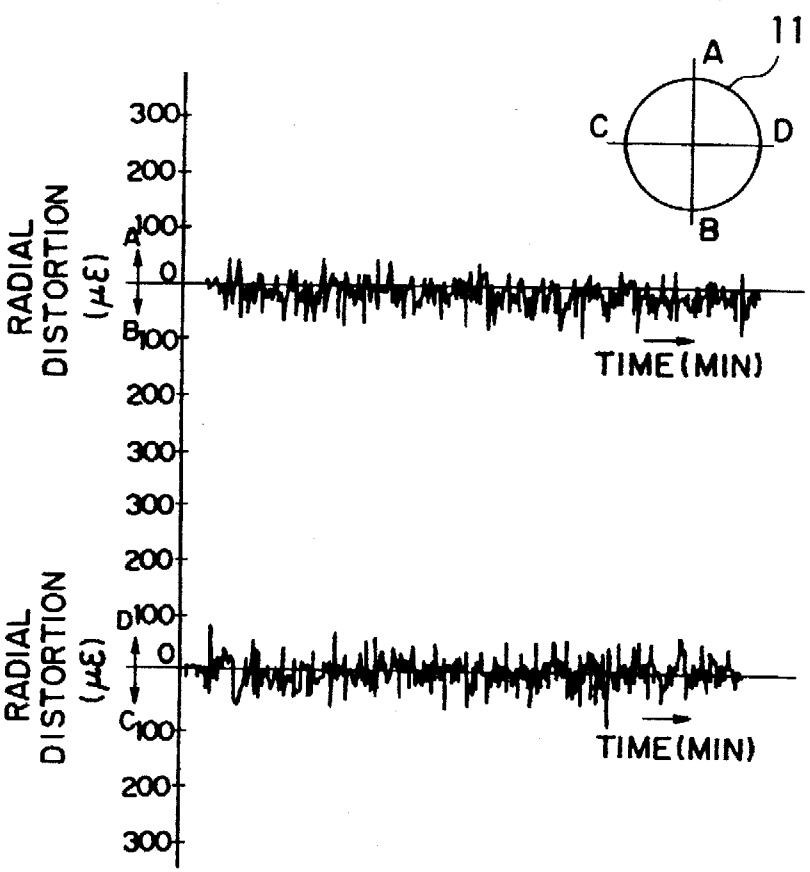
FIG. 4A and FIG. 4B are graphs showing measured data of radial distortion when an auger type ice making machine provided with a conventional auger and an auger type ice making machine provided with the auger of FIG. 2 are operated, respectively.
Figure 4A:
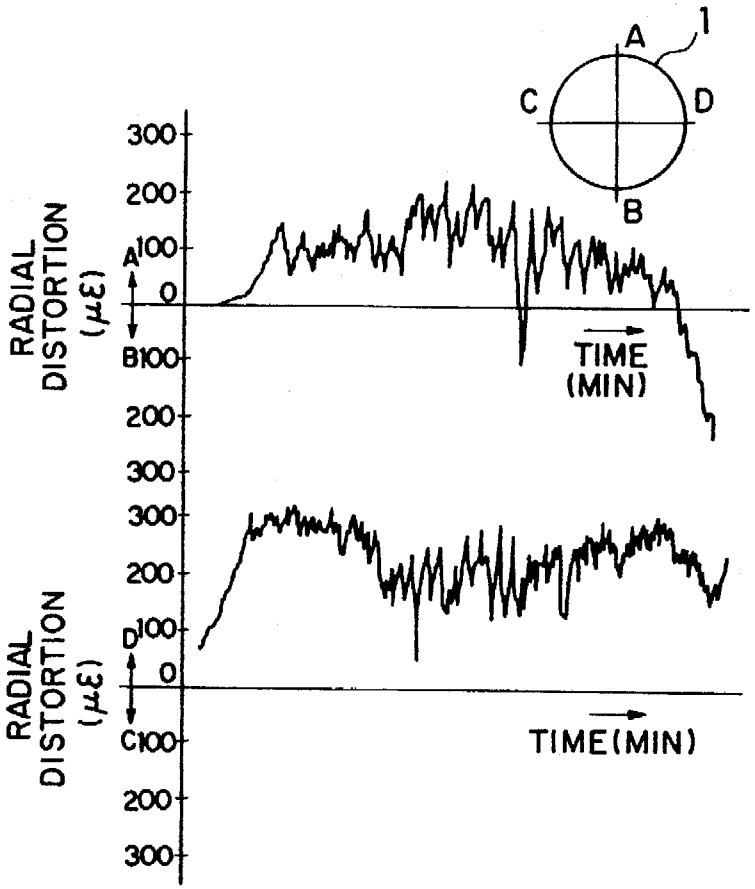
Figure 7:
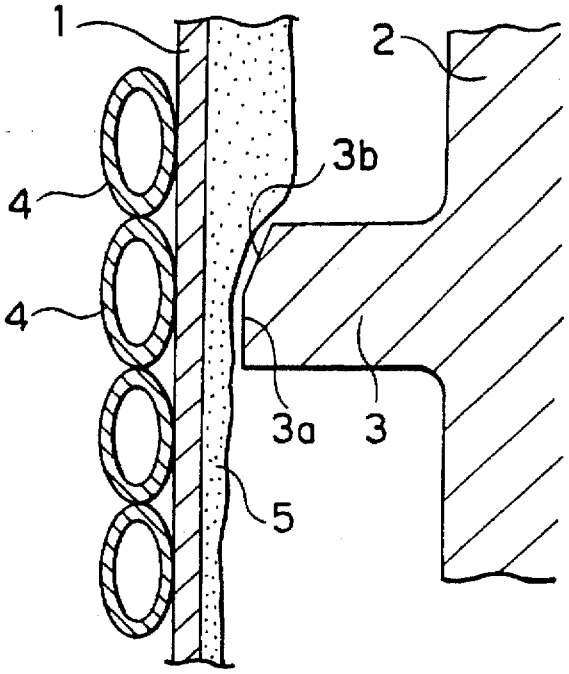
FIG. 7 PRIOR ART
FIG. 7 is an enlarged cross sectional view showing a spiral blade of a conventional auger.
Figure 8:
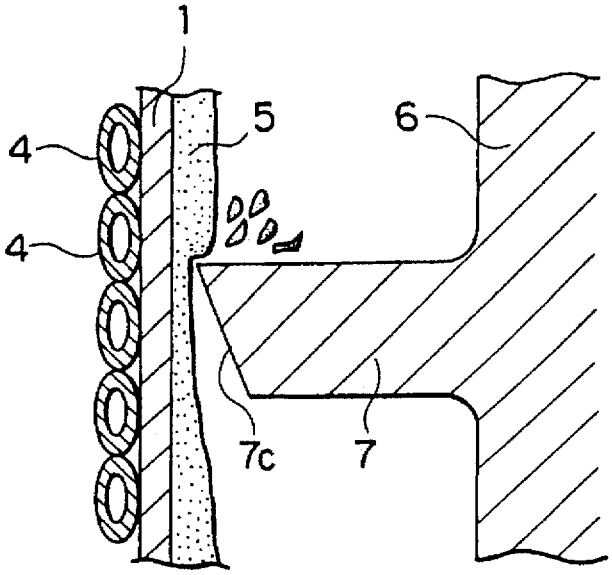
FIG. 8 PRIOR ART
FIG. 8 is an enlarged cross sectional view of a spiral blade of another conventional auger.

Trial runs were conducted to a conventional auger type ice making machine having the auger 2 shown in FIG. 7 and an auger type ice making machine of this embodiment having the auger 12 shown in FIG. 2, and torque distortion and radial distortion produced were measured by using a commercially available instrument. FIG. 3A and FIG. 3B show results of measurement of the torque distortion in the conventional auger type ice making machine and the auger type ice making machine of this embodiment, respectively. Likewise, FIG. 4A and FIG. 4B show results of measurement of the radial distortion in the conventional auger type ice making machine and the auger type ice making machine of this embodiment, respectively. These measurement results were made by approximately accurately copying curves displayed on recording papers.

As is apparent from FIG. 3A and FIG. 3B, a torque distortion of the auger type ice making machine having the auger 12 of this embodiment is reduced to about one half that of the conventional auger type ice making machine having the auger 2. When this is expressed by being converted into a torque load, the conventional ice making machine has a maximum value of 35 Kgfm, whereas this embodiment has a maximum value of 13.4 Kgfm. Thus a substantial improvement is provided by the invention. Further, FIG. 4A and FIG. 4B show radial distortion in two directions A–B and C–D which are at right angles to each other when the refrigerated casings 1 and 11 are observed from the upper side thereof. As is apparent from these figures, a maximum radial load of the auger type ice making machine of this embodiment is reduced to one half that of the conventional auger type ice making machine. Further, a radial load is not offset in one direction.

As described above, the surfaces constituting the spiral blade 13 of the auger 12 of this embodiment do not include a surface extending in a vertical direction parallel with the axial center of the refrigerated casing 11. Consequently, when the ice layer 15 made around the inner periphery of the refrigerated casing 11 is scratched, large noise is not produced and a radial load applied to the auger 12 is reduced. Also, a torque load is reduced in addition to the radial load, whereby a load applied to an ice scratching force, i.e. a load applied to the drive motor 16, can be reduced. Moreover, since the tapered surface 13*c* constituting the spiral blade 13 extends inward in a radial direction from the lower end edge to the upper end edge thereof and the lower end edge is positioned at the radially outermost location of the tapered surface 13*c*, that is, the tapered surface 13*c* faces in a direction toward which scratched ice is fed, the tapered surface 13c acts to feed ice as a whole. Thus, there is provided an auger type ice making machine having a high ice making capacity.

Embodiment 2

When the refrigerating unit has an increased cooling capacity, water making ice and its vicinity has a lower temperature or a rotational speed of the auger 12 is greatly reduced in the ice making machine of the embodiment 1, an amount of ice made around the inner periphery of the refrigerated casing 11 while the spiral blade 13 of the auger 12 rotates once is increased. Thus, there is a possibility that the ice layer 15 is forced onto the upper end surface 13a of the spiral blade 13 rather than the tapered surface 13c thereof. In this case, since a downward pressure in the axial direction acts on the spiral blade 13, a torque load or thrust load applied to the auger 12 is increased.

To solve this problem, an ice making machine according to an embodiment 2 has a spiral blade of an auger which is designed such that even if a thickness of the ice layer 15 made around the inner periphery of the refrigerated casing 11 reaches a predictable maximum thickness in the auger type ice making machine, ice can be made without substantially increasing the aforesaid torque load and thrust load.

Figure 5:
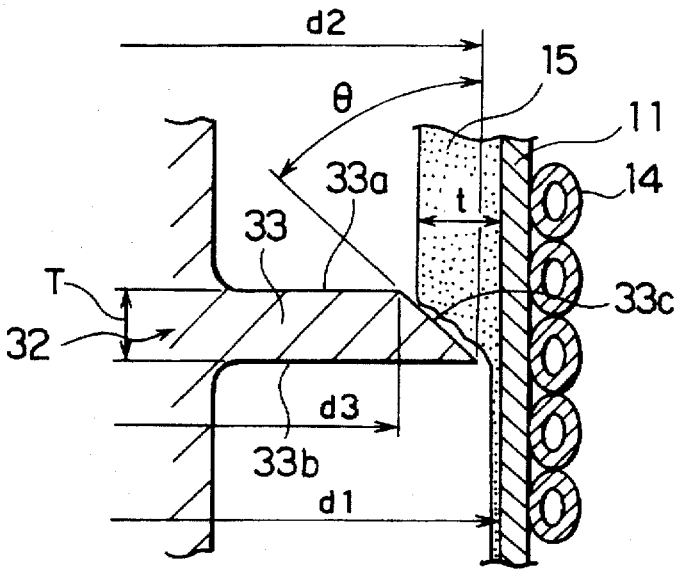
FIG. 5 is an enlarged cross sectional view showing a spiral blade of an auger in another embodiment.

FIG. 5 shows a longitudinal cross section of a spiral blade 33 of an auger 32 according to the embodiment 2. The spiral blade 33 is formed to a shape similar to that of the spiral blade 13 of the auger 12 in the embodiment 1 and is composed of an upper end surface 33a, a lower end surface 33b and a tapered portion including tapered surface 33c connecting the upper surface 33a to the lower surface 33b. The tapered surface 33c extends substantially linearly inward in a radial direction from the lower end edge to the upper end edge thereof and the lower end edge is positioned at the radially outermost position of the blade. In the embodiment 2, however, an angle of inclination θ of the taper surface 33c is determined as described below.

That is, a thickness of the ice layer 15 is determined by various conditions such as material and plate thickness of the refrigerated casing, environmental temperature and the like, in addition to cooling capacity of the refrigerating unit, temperature of ice making water, rotating speed of the auger, pitch of the spiral blade and the like. Among these conditions, since the rotating speed of the auger, the pitch of the spiral blade, and the material and the plate thickness of the refrigerated casing and the like are conditions inherent to identical auger type ice making machines, it may be contemplated that they are substantially given. On the other hand, the temperature of the ice making water, the cooling capacity of the refrigerating unit and the like may vary even in identical auger type ice making machines, and the thickness of the ice layer 15 varies within a range of $t_{min} \leqq t \leqq t_{max}$ depending upon the variable range of the respective conditions. Consequently, this embodiment designs the spiral blade 33 of the auger 32 so that even if the thickness t becomes a maximum thickness $t_{max}$ (not shown), the scratching of the ice layer 15 by the spiral blade 33 can be carried out on the tapered surface 33c.

In FIG. 5, when a radius of the inner periphery of the refrigerated casing 11 is represented by d1, a radius of the spiral blade 33 at the extreme end of the lower end surface 33b thereof is represented by d2, a radius of the spiral blade 33 at the extreme end of the upper end surface 33a thereof is represented by d3, a thickness of the spiral blade 33 is represented by T, and an angle between the taper surface 33c and a vertical surface is represented by θ, a condition under which the ice layer 15 is not forced onto the upper end surface 33a is to satisfy the following expression.

$$d1-d3 \geqq t$$

Since d3=d2−T·tan θ, it eventually suffices to determine the angle of inclination θ to satisfy the following expression.

$$d1-d2+T\cdot\tan\theta \geqq t$$

For example, it is experimentally confirmed that a thickness t of an ice layer 15 varies within a range of about 0.8 mm<t<1.3 mm when a temperature of ice making water (in the case of a water cooling type) is 5° C. to 30° C. and an environmental temperature (in the case of an air cooling type) is 5° C. to 35° C. in an auger type ice making machine having the spiral blade 33 with radius d1=40.5 mm, d2=40 mm, and blade thickness T=6 mm. Thus, when the angle of inclination θ of the tapered surface 33c is designed to θ≧6°, a disadvantage that the ice layer 15 is forced onto the upper surface 33a of the spiral blade 33 can be prevented in any state.

Embodiment 3

Figure 6:
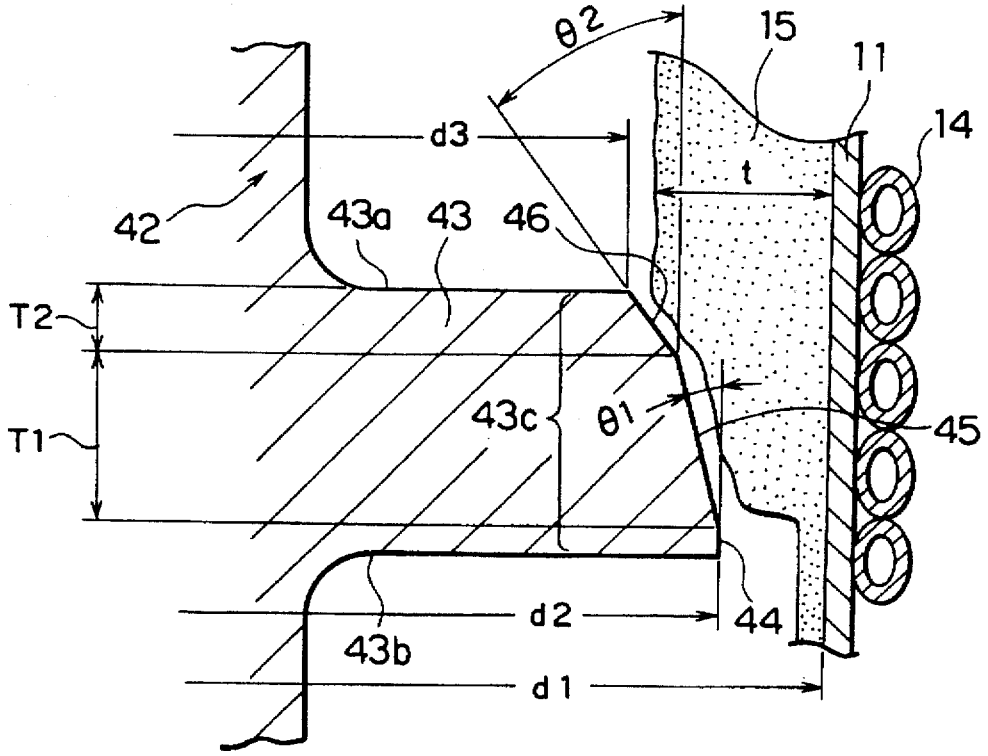
FIG. 6 is an enlarged cross sectional view showing a spiral blade of an auger in a still another embodiment.

A tapered surface of a spiral blade of an auger need not be formed by a single surface but the spiral blade may have a plurality of tapered surface as shown in, for example, FIG. 6. A surface 43c connecting both the extreme ends of the upper end surface 43a and the lower end surface 43b of a spiral blade 43 is not formed by a single surface but is composed of a lower side axial or vertical surface 44, which has a relatively short length of a degree by which an excessive radial load is not substantially applied in a radial direction when an ice layer 15 is scratched, and a lower side tapered surface 45 and an upper side tapered surface 46 which are inclined at angles θ1, θ2 (θ1<θ2), respectively, with respect to the lower side vertical surface 44. When a radius d1 of the inner periphery of a refrigerated casing 11 is represented by d1, a radius of the spiral blade 43 at the extreme end of the lower surface 43b thereof is represented by d2, a radius of the spiral blade 43 at the extreme end of the upper surface 43a thereof is represented by d3, a condition under which the ice layer 15 is not forced onto the upper end surface 43a is to satisfy the following expression.

$$d1-d3 \geqq t$$

When axial thicknesses in a vertical direction of the lower side tapered surface 45 and the upper side tapered surface 46 are represented by T1, T2, respectively, since d3=d2−(T1·tan θ1+T2·tan θ2), when the spiral blade 43 is designed to satisfy the following expression, a disadvantage that the ice layer 15 is forced onto the upper surface 43a of the spiral blade 43 can be prevented.

$$d1-d2+(T1\cdot\tan\theta1+T2\cdot\tan\theta2) \geqq t$$

Further, when the spiral blade 43 is provided with the lower side vertical surface 44, and the lower side tapered surface 45 and the upper side tapered surface 46 which are inclined with respect to the lower side vertical surface 44 at angles θ1, θ2 (θ1<θ2), respectively, even if the ice layer 15 is thin, it can be effectively scratched and fed upward.

Note, although FIG. 6 shows the auger provided with 433 two tapered surfaces 45 and 46, it may be provided with more than two tapered surfaces which are inclined at different angles to each other.

What is claimed is:

1. An assembly of an auger accommodated in a vertically disposed cylindrical refrigerated casing in an auger type ice making machine for scraping an ice layer of thickness t formed around an inner periphery of said refrigerated casing and feeding the scraped ice upwardly, said auger comprising:

a columnar main body;

a spiral blade disposed around an outer periphery of said main body;

said spiral blade including an upper end surface extending radially outwardly from said main body, a lower end surface spaced axially from said upper end surface and extending radially outwardly from said main body, and a tapered portion extending inwardly and upwardly from an extreme radially outer end of said lower end surface to an extreme radially outer end of said upper end surface; and said tapered portion having a configuration and disposition relative to said inner periphery of said refrigerated casing and to the thickness t of the ice layer formed thereon such that said tapered portion forms means for preventing the ice layer from being forced onto said upper end surface.

2. An assembly as claimed in claim 13, wherein said tapered portion comprises, as viewed in axial cross section of said auger, a tapered surface that tapers rectilinearly from a radially outermost portion at said outer end of said lower end surface to a radially innermost portion at said outer end of said upper end surface, and wherein said tapered surface is formed to have an angle of inclination θ which satisfies the following expression:

$$d1-d2+T\cdot\tan\theta\geqq t$$

wherein d1 is a radius of said inner periphery of said refrigerated casing, d2 is a radius of said spiral blade at said extreme end of said lower end surface, and T is a thickness of said tapered surface in an axial direction of said main body.

3. An assembly as claimed in claim 1, wherein said tapered portion comprises, as viewed in axial cross section of said auger, a lower tapered surface tapering rectilinearly upwardly and inwardly at a first angle of inclination θ and an upper tapered surface tapering rectilinearly upwardly and inwardly from said lower tapered surface at a second angle of inclination θ2 greater than said first angle of inclination θ1.

4. An assembly as claimed in claim 3, wherein said θ1 and said θ2 satisfy the expression:

$$d1-d2+(T1\cdot\tan\theta1+T2\cdot\tan\theta2)\geqq t$$

wherein d1 is a radius of said inner periphery of said refrigerated casing, d2 is a radius of said spiral blade at said outer end of said lower end surface, and T1 and T2 respectively are thicknesses of said lower tapered surface and said upper tapered surface axially of said main body.

5. An assembly of an auger accommodated in a vertically disposed cylindrical refrigerated casing in an auger type ice making machine for scraping an ice layer of thickness t formed around an inner periphery of said refrigerated casing and feeding the scraped ice upwardly, said auger comprising:

a columnar main body;

a spiral blade disposed around an outer periphery of said main body;

said spiral blade including an upper end surface extending radially outwardly from said main body, a lower end surface spaced axially from said upper end surface and extending radially outwardly from said main body, and a tapered surface rectilinearly connecting extreme radially outer ends of said upper end surface and said lower end surface, said tapered surface including a radially innermost portion at said extreme outer end of said upper end surface and a radially outermost portion at said extreme outer end of said lower end surface; and said tapered surface being formed to have an angle of inclination θ which satisfies the following expression relative to the thickness t of the ice layer formed around said inner periphery of said refrigerated casing:

$$d1-d2+T\cdot\tan\theta\geqq t$$

wherein d1 is a radius of said inner periphery of said refrigerated casing, d2 is a radius of said spiral blade at said extreme end of said lower end surface, and T is a thickness of said tapered surface in an axial direction of said main body.

* * * * *